US005954444A

United States Patent [19]

Albright

[11] Patent Number: 5,954,444

[45] Date of Patent: Sep. 21, 1999

[54] DYNAMIC FEATHER DIP PEN

[76] Inventor: Kenneth C Albright, 30260 Olinda Trail, P.O. Box 651, Lindstrom, Minn. 55045

[21] Appl. No.: 09/067,843

[22] Filed: Apr. 27, 1998

[51] Int. Cl.[6] ..... B43K 1/01; B43K 17/01; B43K 23/008

[52] U.S. Cl. ..... 401/223; 15/443; 401/231; 401/240; 401/255

[58] Field of Search ..... 401/223, 224, 401/231, 240, 249, 251, 255, 221; 15/444, 443, 445, 435; D19/42

[56] References Cited

U.S. PATENT DOCUMENTS

| | | | |
|---|---|---|---|
| D. 58,431 | 7/1921 | Fish | D19/42 |
| D. 168,531 | 1/1953 | Brudny | D19/42 |
| 359,702 | 3/1887 | Wood | 401/223 X |
| 715,359 | 12/1902 | Dickie | 401/224 |
| 1,177,828 | 4/1916 | Sprankle | 15/444 |
| 1,374,870 | 4/1921 | Zimmerle | 15/444 |
| 1,664,501 | 4/1928 | Benjamins | 401/223 X |
| 2,729,197 | 1/1956 | Ankud | 401/231 |
| 2,802,450 | 8/1957 | Wittnebert | 401/223 |
| 3,565,542 | 2/1971 | Perraud | 401/224 X |
| 4,347,011 | 8/1982 | Yanagita | 401/231 X |

FOREIGN PATENT DOCUMENTS

| | | | |
|---|---|---|---|
| 15080 | 10/1906 | United Kingdom | 401/224 |

*Primary Examiner*—Henry J. Recla
*Assistant Examiner*—Kathleen J. Prunner
*Attorney, Agent, or Firm*—Merchant & Gould P.C.

[57] ABSTRACT

A dynamic feather ink pen enables a user to enjoy all the benefits of the historic form of writing without the disadvantages. The pen includes a grip having an opening extending longitudinally through the grip. A feather having a stem extends through the grip and engages a nib. The stem is slidably engaged within the grip. A portion of the nib is frictionally positioned within the grip, and includes a tip for engaging a writing surface. The stem, the nib and the grip form a reservoir into which an ink filament is positioned.

21 Claims, 2 Drawing Sheets

DYNAMIC FEATHER DIP PEN

FIELD OF THE INVENTION

The present invention relates generally to a writing instrument and specifically to a feather dip pen which uniquely configures a pen holder and a metal nib together with a feather and its attendant feed, and reservoir to provide a novel dynamic feather dip pen.

BACKGROUND

The *Encyclopedia Americana*, International Edition 1995, 100th Anniversary Library Edition, volume 21 page 610 reports that the quill pen has come to us as man's principal writing instrument from 600 A.D. to 1830 A.D., some thirteen hundred years, yet to the present day the quill pen has basically remained unchanged as a writing instrument and likewise its disadvantages of requiring frequent recutting, sharpening or mending of its nib, and tempering it, still remain as obstacles to its present usage.

The metal nib dip pen became the successor to the quill pen by providing a durable nib. In the development of the dip pen, prior art shows initially a reservoir being provided by a stamped out hole on a nib located at the top of the nib's slit. These dip pens are able to store only the amount of ink the "hole-reservoir" is capable of supporting in dramatic suspension over the edges of the hole conforming to its shape. The ink supply is very limited allowing the pen person to write only a few words before needing to be re-dipped into the ink supply. To overcome this insufficient supply of ink to the nib prior art shows calligraphy dip pens utilizing clip-on or factory installed metal reservoirs fitted to the nib itself.

The disadvantage of the clip on reservoir is that it must be attached by hand. A finger adjustment is made by moving the clip up or down the nib to set the reservoir clip at the right spot on the nib. This governs the volume of ink flow through the nib and therefore determines the optimum use of ink to be drawn on the page. If the setting is not correct the pen user must reset the adjustment, but now with a messy ink nib on his hands. Other hand reservoirs assembled at the factory are attached on the top side of the nib and extend down over the nib's tip. This arrangement obstructs the view of the pen user from seeing the tip of the nib as the user seeks to make detailed, artistic, or calligraphic lines on the page or writing material. This is most frustrating to fine work and writing in general. Being made of metal these reservoirs are cumbersome to clean and difficult to keep from corroding.

In the prior art, one may also see dip pens that combine the reservoir and feed as one unit. In such cases the reservoir appears as a finned or serrated portion on the underside of the unit, which when dipped into the supply of ink collects ink on and between its fins. The feed appears as the solid upper part of the unit. It is positioned to lay tangent to the underside of the nib, and feeds ink to the nib from the reservoir's fins. The combined package of nib and reservoir-feed is pushed into the hollowed out cavity of the pen holder. In this configuration the nib and reservoir-feed unit are firmly bonded in a static relationship with the pen holder. The problem here is that because of the close tolerances in a static relationship the ink tends to clog and dry between the nib and the reservoir-feed. Since it is the nature of ink to dry rapidly the problem spreads to the fins of the reservoir. Eventually the system fails to supply a measured amount of ink to the nib. A major problem occurs when disassembly is attempted for maintenance. It is not unusual to discover the parts frozen together by dried ink.

Added to these problems is the inability of the dip pen to make any adjustment to increase or decrease the volume of ink flowing through the slit in the nib onto the writing surface. This requires the use of a variety of nibs, i.e. fine, medium, bold etc., to accommodate the various writing or drawing requirements of the pen user. Further, messy ink spills will likely occur if these nibs are changed while the pen is in use.

Still other dip pens use wicks or reservoirs and feeds of various types with complex apparatus under the nib each attached to the pen holder in prior art customary static configurations. Such static configurations preclude the appearance of a multifunctional dip pen. This omission is a serious limitation to developing the versatility of the dip pen and to eliminating many of its shortcomings.

Furthermore, the feather for years has not been seriously included in the dip pen's configuration. The absence of the feather as a dip pen has kept the historical influence of a powerful living symbol from the hands of a teacher. This is the loss of a significant motivating teaching tool. A tool that could be used to inspire young children in character development during their formative years of education.

The common experience when writing with prior art dip pens which utilize statically configured systems is that one must make a choice, to use dip pens in spite of their problems or to abandon the dip pen and go to the fountain pen, or ball point pen. There remains the need for an alternative choice. The present invention offers that alternative as disclosed in the summary of the invention.

SUMMARY OF THE INVENTION

It is the intention of the present invention to uniquely utilize the feather to overcome the varied mentioned problems of the quill pen and the metal nib dip pen.

The decline of the dip pen is due in some degree to the fact that prior art has been confined to static configurations.

It is the intention of the present invention to provide a dynamic configuration for a dip pen through the use of the feather. Such a configuration will allow for a significant advancement in the value of the dip pen as a writing instrument. In doing so the invention reintroduces the feather pen as a new dynamic feather dip pen, a desirable, dependable, pleasurable pen to write with, a pen adaptable, and useable to teachers, parents, and school children as an authentic historical writing instrument.

In summary the present invention will renew a general interest and use of the dip pen. The invention provides a dip pen where the reservoir will not rust or corrode. It provides a feed which will not contribute to ink clogging, drying and freezing assembled parts. A pen is provided that provides an equal supply of ink to the nib for each dip in the ink supply so that the user's train of thought is not broken by an unexpected need to re-dip the pen. The pen also allows the user to govern the type and kind of line to be drawn on the writing surface without changing the nib. The user will also be immediately identified with the historic profile of the feather dip pen.

It is the object of the invention to uniquely configure the component parts of the feather dip pen; the grip or pen holder, the metal nib, and the feather in a dynamic relationship, enabling the respective components to function with mechanical effect between them. In so doing, it is an object of the invention to increase the ink volume capacity of the feather dip pen's natural reservoir, as well as to eliminate the ability of ink to adhere to the surface of the dip pen's grip. These improvements are to enhance in a quantum way the versatility and performance of the feather dip pen as a handwriting instrument so as to provide a new dynamic feather dip pen.

Another object of the invention is to uniquely use a grip to enable a dynamic relationship to function between the feather and the nib.

A further object of the invention is to uniquely utilize the natural attributes of the complete feather with its uncut bent end to provide a mechanical effect between the nib and the grip of the pen.

Further it is a object of the invention to use a nib to enable a dynamic relationship to function between the feather and the grip of the pen.

Still further it is an object of the invention to provide a feed to enable the pen person to dynamically and mechanically adjust the expansion and contraction of the size of the slit in the nib, and thereby govern the size of the width of ink flowing from the nib onto the writing surface so that the line drawn may be fine, medium, or bold, according to the need of the user, without changing the nib.

A further object on the invention is to use the feather to provide a reservoir for storing and feeding ink to the slit in the metal nib. In doing so it is the intention of the invention that the reservoir and feed function in a coordinate manner to both store and to mechanically increase or decrease the flow of ink onto the writing surface and thereby govern the frequency with which the pen will need to be re-dipped into an ink supply.

It is a further objective of the invention to uniquely provide an ink filament which may be readily applied or removed from the reservoir. The filament is to hold the supply of ink for the reservoir when dipped into an ink supply and to provide an equal supply of ink for the reservoir at each dip, thus assuring the user an equal lapse of time between dips.

It is also an object of the invention to streamline the configuration of the reservoir and feed to retain the feather's historic profile as a feather dip pen.

A further object of the invention is to unite the feather in this unique configuration to make the dynamic feather dip pen a desirable, dependable, pleasurable pen to write with, a pen adaptable, and useable to teachers, parents, and school children, as a historic motivational writing instrument.

The following summary presents the unique way in which the present invention uses the feather as a reservoir and a feed in a unique dynamic relationship between the grip and the metal nib to provide a new dynamic feather dip pen.

By providing a new and dynamically configured feather dip pen the present invention replaces the way these components are configured in prior art static configurations. In doing so the invention eliminates complex reservoir and feed systems, messy finger adjustment, and dry clogging ink. It provides an easy means to see and set the slit in the nib. It gives a clear view of the nib's tip while designing, drawing, or writing. It provides easy maintenance and gives the pleasure and joy of writing with a new feather dip pen.

In summary, the invention uniquely utilizes the entire natural feather with its uncut resilient stem and bent end as a reservoir and a feed. It functions as a feed by employing a grip which has a central longitudinal hole that traverses the entire length of the grip. In the upper end of this hole a short hollow metal tube is inserted and permanently bonded in place. Into the lower end of the grip's hole a metal nib is inserted being firmly secured and held in position by a tight friction fit. Into the hollow tube and top end of the grip's longitudinal hole the stem end of the feather with its characteristic natural bent end, (which may be artificially increased by heat), is inserted to pass through the grip until it presses against the underside of the metal nib.

The feather with its resilient stem and bent end causes it to possess dynamic features of a curve at its bent end. Therefore, when the feather is pressed down upon at any point on the opposite side of the curve the feather will be springy. With this natural characteristic it is inserted into the grip with the tip of its bent end pressing against the bottom side of the nib. Simultaneously, the back side of its curve presses against the inside of the grip's hole. From this point a very short distance up the stem the natural increasing taper of the feather's stem has a squeezed fit through the hollow tube. Hence, the feather is held in a unique dynamic relationship with its integral component parts by friction and spring tension at the three pressure points: against the bottom of the nib; the middle of the grip; and the inner surface of the hollow tube.

At the choice of the user, the feather may be inserted further into the grip to bring greater pressure to the underside of the nib. This will cause the slit in the metal nib to spread open, allowing the tip of the bent end to feed a greater amount of ink to the slit of the nib. Conversely, if the feather is pulled slightly out of the grip the slit in the nib will be reduced or closed.

Another natural feature of the feather's bent end is that when inserted into the grip as indicated above, its curve is in the proper mode or position to provide a natural cradle, valley, or vacant space. This vacant space or cradle area transverses from the bottom of the grip along the top of the feather's stem up to the very tip of its bent end which comes to rest against the underside of the nib. This entire vacant area on the feather's stem is identified as the pen's reservoir. In this reservoir area a streamlined small narrow strip of fibrous material, known as the ink filament, is pressure bonded by double sided transfer tape. It adheres in its streamlined form as an integral part of the natural curve of the feather, maintaining the feather's historic profile. The ink filament loads itself with ink when the pen is dipped in an ink supply and functions in tandem with the pen's reservoir to release ink to flow down the curve of the feed into the slit in the nib as the point of the nib is pressed against the writing surface. The ink filament is made of a fibrous brass wool material. The function of the ink filament is to increase the capacity of the reservoir's ink volume. The ink filament is readily cleansed by rinsing it under the water faucet. If replacement is ever needed a user need only pull the feather out of the grip, peel off the old ink filament and press on a new one. This provides a reservoir system characterized by durability against corrosion, rinsibility, an ability to retain greater ink volume while allowing a continuous clog free flow of ink from the reservoir to the nib, and its aesthetically pleasing color of gold matches the gold colored nib.

Another advantage of the unique dynamic relationship between component pen parts is that by either increasing or decreasing the size of the slit in the nib or increasing or decreasing the size of the ink filament or the combination of both, a measured frequency or infrequency of dipping in the ink supply may result. The constancy of this measured frequency is assured by the extreme reliability of the ink filament to absorb an equal volume of ink at each refill. This greatly reduces the frustration and irritation at having your pen run out of ink in the middle of a thought, a very frustrating and irritating experience to persons writing by hand.

In addition to these significant contributions the feather resolves other problems. Since the reservoir is made of the feather's stem it will not rust or corrode. Furthermore, since the feather's feed is not static but dynamic in its configuration it will not clog and dry to block the flow of ink from the reservoir through the feed to the nib, nor will it dry freeze moveable assembled parts.

Since the "whole is more than the sum of its parts" yet the whole requires all of its parts so that in addition to the feather's unique contribution which provides the very means to the existence of the invention and the very means to the varied functions and mechanical effects of the invention so too there is the improvement of the reservoir system by the ink filament of the invention. Similarly, it is the intention of the invention to improve the utility of a dip pen's grip by coating it with polytetrafluoroethylene, also identified as P.T.F.E. P.T.F.E. is a thermoplastic resin having an extremely low coefficient of friction. It is uniquely incorporated into the present invention to prevent ink from adhering to the grip as the pen is dipped into the ink supply. This coating assures that no ink will remain on the grip to stain the fingers. Such an improvement in the utility of the grip removes the last obstacle to popular dip pen usage. Each of the objects of the invention taken together as a whole are unique configurations and improvements over prior art feather dip pens and thereby, as a whole and in part, uniquely improve the pleasurable use of the feather as a dip pen, so that now the pen person may pick up a new Dynamic Feather Dip Pen and write with confidence.

The above summary of the present invention is not intended to describe each illustrated embodiment or every implementation of the present invention. The figures in the description which follow more particularly exemplify these embodiments.

DETAILED DESCRIPTION

The present invention uniquely utilizes and configures its various components to construct a dynamic feather dip pen. In the following detailed description, reference is made to the accompanying drawings which form a part hereof, and in which is shown by way of illustration specific embodiments in which the invention may be practiced. These embodiments are described in sufficient detail to enable those skilled in the art to practice the invention and it is to be understood that other embodiments may be utilized and that structural, logical and mechanical changes may be made without departing from the spirit and scope of the present invention. The following detailed description is, therefore, not to be taken in a limiting sense.

Figure 1:
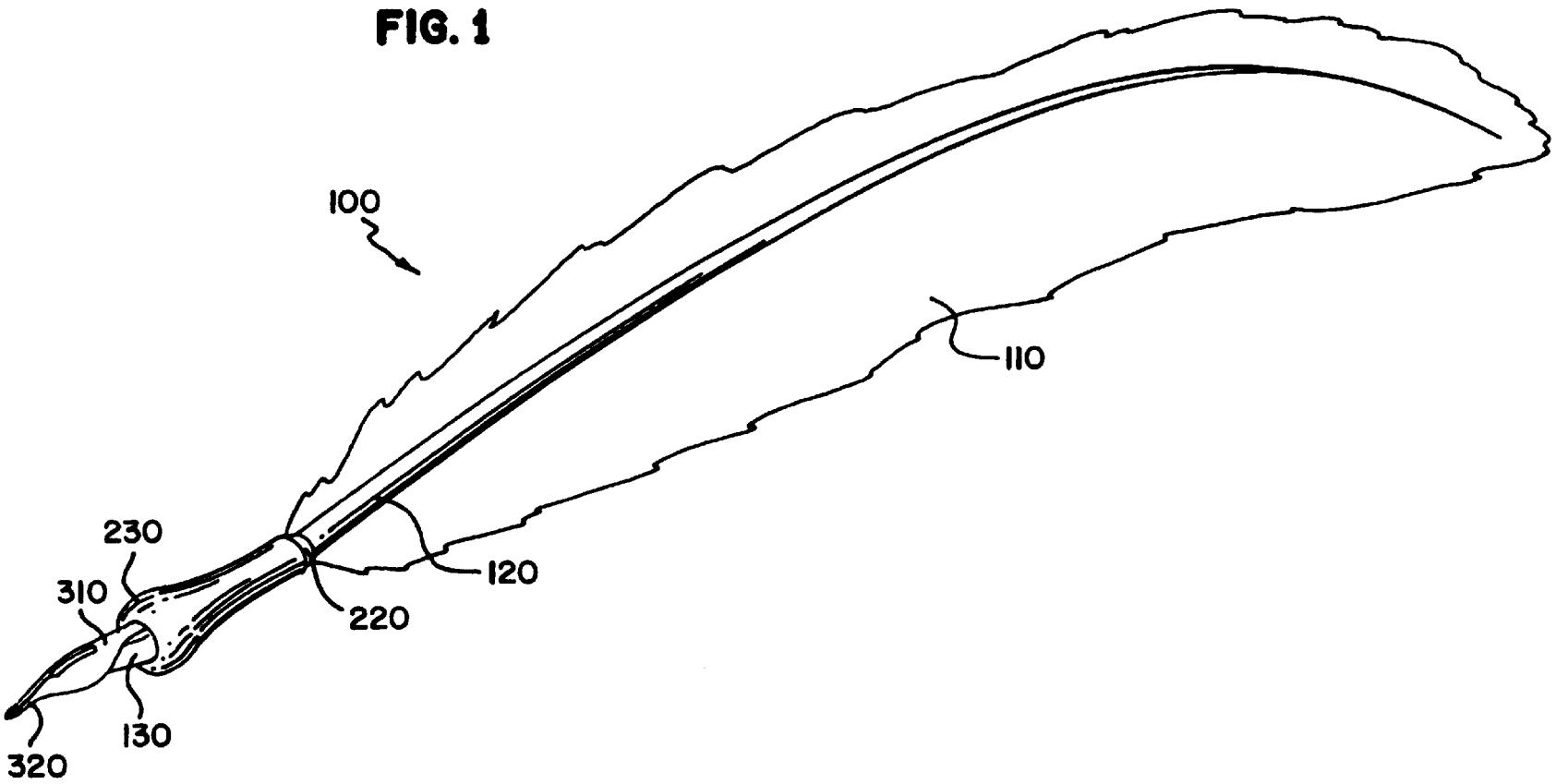
FIG. 1 is a perspective view of one embodiment of the fully assembled feather ink pen made according to the present invention.

The identification of component parts of a completely assembled dynamic feather dip pen 100 are shown in FIG. 1. The pen includes a feather 110 which has a stem 120 with a bent end 130. Embodied with the feather 110 is a metal nib 310 having a slit 320 and a grip 210 with a metal tube 220 inserted within the opening of the grip 210. In one embodiment, polytetrafluoroethylene [P.T.F.E.] 230 or some other suitable substance that prevents liquid ink from adhering to the grip 210, is applied to the lower portion of the grip 210 adjacent the nib 310. Application of this anti-adhering substance guarantees that ink will not work its way up the grip 210 to stain the fingers of the pen user when the pen is dipped into the ink supply.

Figure 2:
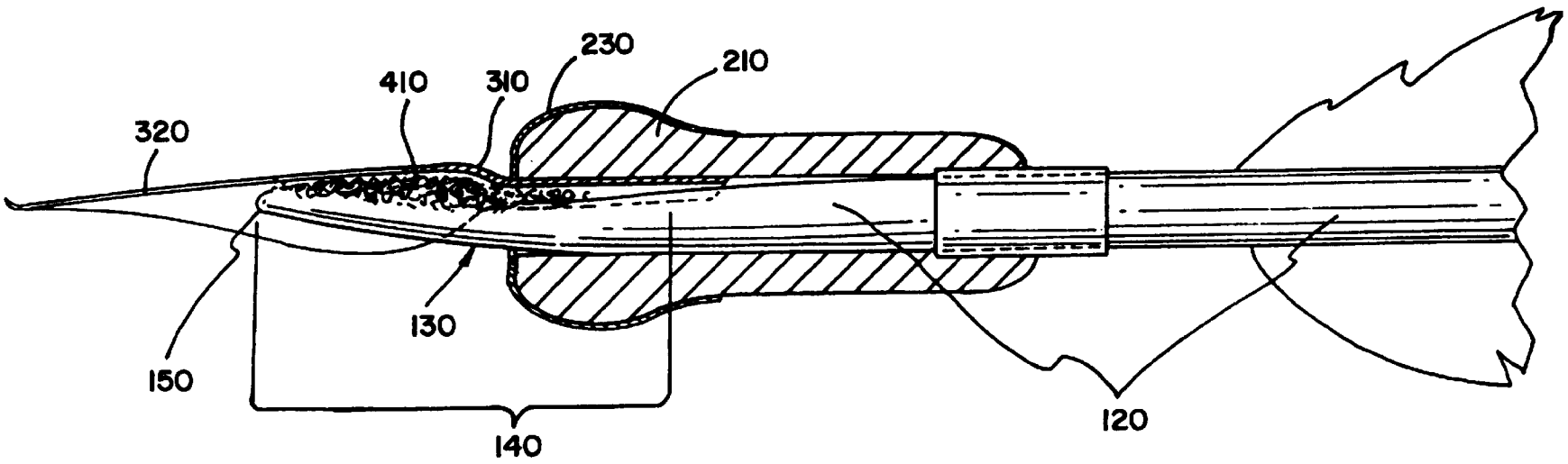
FIG. 2 is a side view of the embodiment shown in FIG. 1, partially cut away to illustrate the internal structure thereof.

In FIG. 2 particular parts are described by their unique attributes. The present invention uniquely utilizes the natural attribute of the bent end 130 of the feather's stem 120 as the reservoir 140. The reservoir is formed by the natural curve made by the bent end 130 which provides a natural cradle, valley, or vacant space sufficient to provide a natural reservoir 140 which traverses longitudinally along the top of the space of bent end 130 from the feed 150 until it enters the grip 210. Additionally, it is to be noted that the angle of the bent end 130 in the feather's stem 120 may be artificially increased by heating and bending it. In doing so the area of the reservoir 140 to hold ink is increased. Further, in the preferred embodiment an ink filament 410 is pressure bonded on top of the reservoir 140. This is done to increase the capacity of ink volume in the reservoir 140 to assure that an equivalent volume of ink is loaded into the reservoir 140 each time it is dipped into an ink supply. The ink filament 410 may be made of a bronze wool material which will not shrink or otherwise lose its ability to consistently hold the same amount of ink. The ink filament 410 is bonded within the reservoir 140 on the top surface side of bent end 130. It is the combined natural durable and smooth tip of the feed 150, and bent end 130 with the reservoir 140 that enables the feather to effectively apply leverage to open and close the slit 320 in the nib 310. The feather's feed 150 also functions to channel the ink from the reservoir 140 to the slit 320. It is because of the feather's bent end feature that these functions are possible.

Since each feather's natural bent end is unique unto itself it becomes necessary to heat treat each feather's bent end 130 to custom fit it for the particular nib being used, e.g., oval or straight, etc. This is accomplished by heating the bent end and bending it by hand to adjust the angle of the bent end 130 so its feed 150 will come to rest against the middle of the underside of nib 310 where slit 320 begins its descent to the tip of the point of nib 310. In adjusting the angle to the bent end 130 caution must be given to not increase the angle of the bent end too much so as to prohibit it from passing through the longitudinal hole in grip 210 during assembly.

For assembly line production to overcome this hand adjustment hardship the preferred method to make this angle adjustment is to prefabricate a plastic piece to fit the needed angle of the bent end to match the particular shape of the nib being used. This piece is made to incorporate the bent end 130, reservoir 140 and feed 150 into one unit. It is bonded to the feather's stem becoming one with it.

The assembly procedure for the pen involves inserting into the bottom end of the grip 210 a metal nib 310 which is tightly held in position by friction. Into the top end of the grip 210 a metal tube 220 is inserted and bonded in place by an adhesive. The metal tube 220 functions to protect the grip 210 from spitting and holds the stem 120 of the feather 110 by friction. The stem 120 of the feather 110 is passed through the top end of the metal tube 220 and grip 210 until it presses against the bottom side of the nib 310. The portion of the stem extending outward from the grip and engaging the nib 310 functions as the feed 150. Again, it is noted that the reservoir 140 area traverses from the very end of the feed 150 longitudinally along the top of the reservoir 140 area to where it enters the bottom of the grip 210 and extends partially into the grip 210.

Thus assembled the composite configuration of all component parts function in concert so that upon dipping the pen 100 into an ink supply, ink will be held in retention in the reservoir 140 by the ink filament 410 until it is released to flow down the feed 150 (formed by the stem) into the slit 320 in the nib 310 and onto the writing surface as the point of the nib 310 is pressed against a writing surface.

The feather's uncut bent end 130 provides the ability to configure the pen in a unique manner to enable a mechanical effect between each of the component parts. To describe this mechanical effect it may be said that since the feather is naturally resilient there is a "give" in its bent end 130 when pressed upon from its back side. That is, there is a springiness to the bent end 130 of the feather 110. Once the stem 120 of the feather is inserted in the grip 210 the tip of the feed 150 presses against the bottom of the nib 310. A short distance from the tip of the feed 150 the stem 120 is bent. This bentness in the stem 120 will cause a portion of the stem 120 as it enters the bottom of the grip 210 to press against the inside of the grip's hole about mid-way through the grip 210. From this point the stem's increasing taper will be squeezed upon by the metal tube 220 as it exits the tube 220. Therefore, in this configuration there will be strong gripping tension placed upon the stem 120 at three points: (a) by the bottom of the metal nib 310 which itself is somewhat flexible pressing up against the tip of the feed 150; (b) by the inside wall of the grip 210 as the back side of the stem 120 is pressed upon by the immovable inside wall of the grip 210; and (c) by the metal tube 220 where the stem 120 is being squeezed as it exits the tube 220.

This spring tension relationship permits mechanical movement of the feather within the grip 210 because the pressure at each point is strong and firm enough to maintain the feather 110 in position yet it is not rigidly binding. Hence, the principles of a dynamic relationship are at work between the feather 110, grip 210, and nib 310. Therefore, to move the feather further into the grip 210 will spread the slit 320 further apart, and pulling the feather out of the grip 210 will cause the slit 320 to decrease. With this dynamic relationship, if the pen user desires to enlarge the line at the writing surface, the slit 320 should be increased to allow more ink to flow from the reservoir 140. Should the line be thinner with less ink on the writing surface the opening in the slit 320 must be decreased.

Additionally, if the pen user desires to increase the time lapse between re-dipping in the ink supply it may be accomplished by narrowing the nib's slit 320 so the nib 310 uses less ink, and at the same time the user should replace the existing ink filament 410 with a larger or denser one to increase the reservoir's 140 ink capacity. By coordinating these two functions the user controls the time lapse for re-dipping the pen in the ink supply, and sets the size of the line to be drawn on the writing surface.

While the invention has been described in connection with what is presently considered to be the most practical and preferred embodiment, it is to be understood that the invention is not to be limited to the disclosed embodiment, but on the contrary, is intended to cover various modifications and equivalent arrangement included within the spirit and scope of the appended claims.

The above specification, examples and data provide a complete description of the manufacture and use of the composition of the invention. Since many embodiments of the invention can be made without departing from the spirit and scope of the invention, the invention resides in the claims hereinafter appended.

I claim:

1. A pen comprising:

a grip having first and second ends and an opening that extends longitudinally through the center of the grip between the first and second ends;

a nib frictionally engageable within the opening of the grip at the first end, the nib having a tip for engaging a writing surface;

a feather having a stem, the stem extending through the opening outwardly from first end and engaging the nib, wherein the stem, the nib and the grip at the first end define a reservoir; and an ink filament positioned within the reservoir, the ink filament holding a supply of ink for the reservoir when the pen is dipped into an ink supply.

2. The pen of claim 1, further comprising a tube positioned within the opening of the grip adjacent the second end, wherein the tube slidingly secures the stem within the grip.

3. The pen of claim 1, wherein the stem is slidable within the opening of the grip.

4. The pen of claim 3, wherein the tip of the nib defines a slit, the size of the slit expanding and contracting in response to the longitudinal movement of the stem.

5. The pen of claim 1, wherein the ink filament connects to a portion of the stem that extends out from the first end of the grip, and wherein the stem feeds the ink from the reservoir to the tip of the nib.

6. The pen of claim 1, wherein the first end of the grip is configured and arranged so that ink does not adhere or penetrate the surface of the grip at the first end.

7. The pen of claim 6, wherein the first end of the grip is coated with polytetrafluoroethylene.

8. A pen comprising:

a feather having a stem with a bent end;

a grip having first and second ends and an opening that extends longitudinally through the grip, wherein the stem passes through the opening and the bent end of the stem extends outward from the first end of the grip;

a nib frictionally engageable within the opening at the first end, wherein the bent end of the stem, the nib and grip define a reservoir; and holding means for holding a supply of ink for the reservoir when the pen is dipped into an ink supply.

9. The pen of claim 8, wherein the holding means is an ink filament of bronze wool positioned within the reservoir.

10. The pen of claim 9, wherein the ink filament connects to a portion of the stem that extends out from the first end of the grip, and wherein the stem feeds the ink from the reservoir to a tip of the nib.

11. The pen of claim 8, wherein the nib includes a tip that defines a slit, and wherein the slit expands and contracts in response to longitudinal adjustment of the stem within the grip.

12. The pen of claim 8, further comprising a tube positioned within the opening of the grip adjacent the second end, wherein the stem passes through and frictionally engages the tube.

13. The pen of claim 8, wherein the first end of the grip is configured and arranged so that ink does not adhere to or penetrate the surface of the grip at the first end.

14. The pen of claim 13, wherein the first end of the grip is coated with polytetrafluoroethylene.

15. The pen of claim 8, wherein the bent end is comprised of the uncut end of the stem.

16. A pen comprising a grip with first and second ends and having an opening extending longitudinally through the grip, a nib frictionally engaged within the opening and having a tip for engaging a writing surface, a feather having a stem extending through the opening, the stem having a bent end extending outward from the grip and engaging the nib, and an ink filament connected to the bent end within a reservoir defined by the bent end, the nib, and the first end of the grip.

17. The pen of claim 16 further comprising a tube positioned within the opening of the grip adjacent the second end, wherein the tube slidingly secures the stem within the grip.

18. The pen of claim 16, wherein the stem is slidable within the opening of the grip.

19. The pen of claim 18, wherein the tip of the nib defines a slit, the size of the slit expanding and contracting in response to the longitudinal movement of the stem.

20. The pen of claim 16, wherein the first end of the grip is configured and arranged so that ink does not adhere to or penetrate the surface of the grip at the first end.

21. The pen of claim 20, wherein the first end of the grip is coated with polytetrafluoroethylene.

* * * * *